US011374320B2

(12) United States Patent
Guo

(10) Patent No.: US 11,374,320 B2
(45) Date of Patent: Jun. 28, 2022

(54) ANTENNA STRUCTURE AND ELECTRONIC DEVICE

(71) Applicant: BEIJING XIAOMI MOBILE SOFTWARE CO., LTD., Beijing (CN)

(72) Inventor: Fang Guo, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 49 days.

(21) Appl. No.: 16/900,662

(22) Filed: Jun. 12, 2020

(65) Prior Publication Data

US 2021/0175625 A1 Jun. 10, 2021

(30) Foreign Application Priority Data

Dec. 6, 2019 (CN) ..... 201911242946.8

(51) Int. Cl.

| | |
|---|---|
| ***H01Q 5/371*** | (2015.01) |
| ***H01Q 1/48*** | (2006.01) |
| ***H01Q 9/04*** | (2006.01) |
| ***H01Q 5/335*** | (2015.01) |

(52) U.S. Cl.

CPC ..... *H01Q 5/371* (2015.01); *H01Q 1/48* (2013.01); *H01Q 5/335* (2015.01); *H01Q 9/0457* (2013.01)

(58) Field of Classification Search

CPC ..... H01Q 1/243; H01Q 5/328; H01Q 5/335; H01Q 9/0457; H01Q 5/371

See application file for complete search history.

(56) References Cited

U.S. PATENT DOCUMENTS

2015/0333396 A1 11/2015 Tai et al.
2016/0056522 A1* 2/2016 Kim ..... H01Q 1/243 333/235
2016/0365623 A1* 12/2016 Kim ..... H01Q 9/42
2017/0084998 A1* 3/2017 Ishizuka ..... H04B 1/40

(Continued)

FOREIGN PATENT DOCUMENTS

CN 108631041 A 10/2018
CN 108767450 A 11/2018
CN 108987892 A 12/2018

(Continued)

OTHER PUBLICATIONS

Office Action issued to Korean Application No. 10-2020-0058979 dated May 24, 2021 with English translation, (10p).

(Continued)

*Primary Examiner* — Ricardo I Magallanes
(74) *Attorney, Agent, or Firm* — Arch & Lake LLP

(57) ABSTRACT

The present disclosure relates to an antenna structure and an electronic device. The antenna structure includes: a metal frame body; a first antenna branch coupled to one side edge of the metal frame body; a second antenna branch coupled to the other side edge of the metal frame body; an antenna gap defined by the first antenna branch and the second antenna branch after the first antenna branch and the second antenna branch both extend towards a middle portion of the metal frame body, an extension length of the first antenna branch being greater than an extension length of the second antenna branch; and a feed point with one end coupled to a ground point and the other end coupled to the first antenna branch.

17 Claims, 6 Drawing Sheets

(56) References Cited

U.S. PATENT DOCUMENTS

2019/0044218 A1* 2/2019 Ye ..... H01Q 5/385

FOREIGN PATENT DOCUMENTS

| | | | |
|---|---|---|---|
| CN | 109066067 | A | 12/2018 |
| CN | 109586036 | A | 4/2019 |
| CN | 109687111 | A | 4/2019 |
| CN | 107302125 | A | 11/2019 |
| EP | 2498337 | A1 | 9/2012 |
| JP | H01231404 | A | 9/1989 |
| KR | 20160067541 | A | 6/2016 |
| KR | 20160146138 | A | 12/2016 |
| WO | 2019018115 | A1 | 1/2019 |
| WO | WO-2020135046 | A1 * | 7/2020 |

OTHER PUBLICATIONS

Office Action issued to Japanese Application No. 2020-080018 dated Jun. 25, 2021 with English translation, (11p).
Office Action issued to European Patent Application No. 20182287.1 dated Nov. 2, 2020, (8p).
Office Action for JP application 2020-080018, dated Oct. 8, 2021, submitted with translation, 8 pages.
Office Action for KR application 10-2020-0058979, dated Nov. 4, 2021, submitted with translation, 10 pages.
Office Action for IN application 202044025776, dated Oct. 11, 2021, 5 pages.

* cited by examiner

ANTENNA STRUCTURE AND ELECTRONIC DEVICE

CROSS-REFERENCE TO RELATED APPLICATIONS

This application is based upon and claims priority to Chinese Patent Application Serial No. 201911242946.8, filed on Dec. 6, 2019, the entire contents of which are incorporated herein by reference for all purposes.

TECHNICAL FIELD

The present disclosure relates to a field of terminal technologies, and more particularly to an antenna structure and an electronic device.

BACKGROUND

As a new generation of communication protocol standards, 5G (5th generation mobile network) communication technology has gradually come to the attention of the public. In order to enable electronic devices to support networks of the three major telecom operators under 5G protocol standards and improve the market share of electronic devices, how to set up antenna structures of electronic devices to achieve the full frequency band coverage of the 5G communication technology has become a focus and breakthrough point for designers.

SUMMARY

The present disclosure provides an antenna structure and an electronic device.

According to a first aspect of the present disclosure, an antenna structure is provided. The antenna structure includes: a metal frame body; a first antenna branch coupled to a first side edge of the metal frame body, the first antenna comprising a first free end extending towards a middle of the metal frame body; a second antenna branch coupled to a second side edge of the metal frame body, the second antenna comprising a second free end extending towards the middle of the metal frame body; an antenna gap defined by the first free end and the second free end, wherein a first extension length of the first antenna branch is greater than a second extension length of the second antenna branch; and a feed point comprising a first end coupled to a ground point and the a second end coupled to the first antenna branch.

According to a second aspect of the present disclosure, an electronic device is provided and includes the antenna structure described above. The antenna structure includes: a metal frame body; a first antenna branch coupled to a first side edge of the metal frame body, the first antenna comprising a first free end extending towards a middle of the metal frame body; a second antenna branch coupled to a second side edge of the metal frame body, the second antenna comprising a second free end extending towards the middle of the metal frame body; an antenna gap defined by the first free end and the second free end, wherein a first extension length of the first antenna branch is greater than a second extension length of the second antenna branch; and a feed point comprising a first end coupled to a ground point and the a second end coupled to the first antenna branch.

It is to be understood that both the foregoing general description and the following detailed description are merely exemplary and explanatory and are not restrictive of the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure.

DETAILED DESCRIPTION

Examples of the present disclosure will be described in detail herein, and will be illustrated in accompanying drawings. When the following description refers to the drawings, unless specified otherwise, the same numbers in different drawings represent the same or similar elements. Implementations described in the following examples do not represent all the implementations consistent with the present disclosure. Instead, they are only examples of devices and methods consistent with some aspects of the present disclosure detailed in the appended claims.

The terminology used in the present disclosure is only for the purpose of describing specific examples and is not intended to limit the present disclosure. As used in the description of the present disclosure and the appended claims, "a" and "the" in singular forms mean including plural forms, unless clearly indicated in the context otherwise. It should also be understood that, as used herein, the term "and/or" represents and contains any one and all possible combinations of one or more associated listed items.

It should be understood that, although terms such as "first," "second," and "third" are used herein for describing various kinds of information in the present disclosure, such information should not be limited by these terms. These terms are only used to distinguish the same type of information from each other. For example, without departing from the scope of this disclosure, the first information may also be called the second information, and similarly, the second information may also be called the first information. Depending on the context, the term "if" used herein may be construed to mean "when" or "upon" or "in response to determining".

As a new generation of communication protocol standards, 5G (5th generation mobile networks) communication technology has gradually come to the attention of the public. Nowadays, the 5G frequency bands that the three major domestic operators may use generally include N41 frequency band (2.515 GHz to 2.675 GHz), N78 frequency band (3.4 GHz to 3.8 GHz), and N79 frequency band (4.4 GHz to 5 GHz). Therefore, in order to improve the market share of electronic devices, the electronic devices are configured in a mode that fits all kinds of networks. That is, how to enable the electronic devices to support N41 frequency band, N78 frequency band, and N79 frequency band (i.e., cover a frequency band from 2.5 GHz to 5 GHz) has become a focus for the designers.

Figure 1:
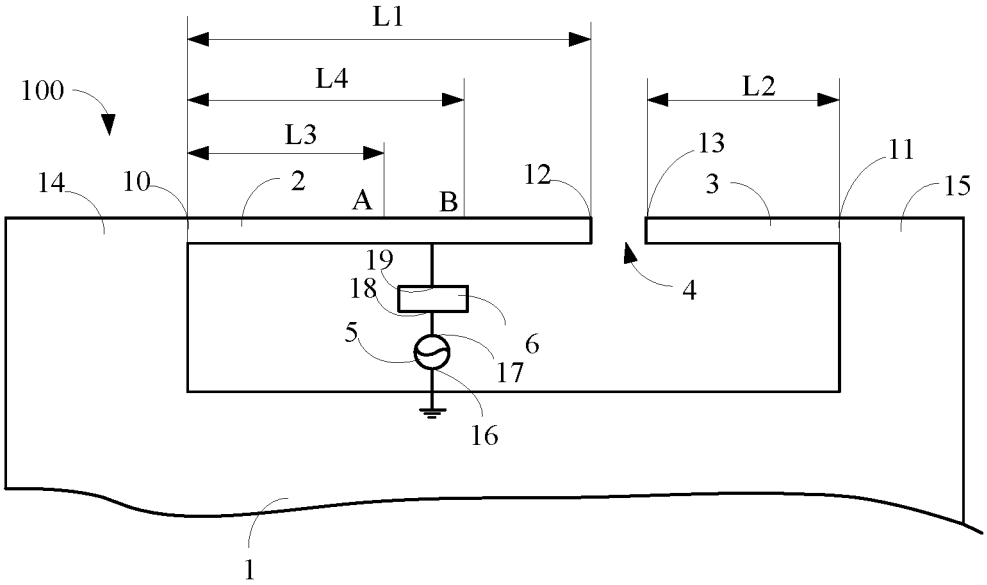
FIG. 1 is a structural diagram of an antenna structure according to an example.

Accordingly, the present disclosure provides an antenna structure 100 as illustrated in FIG. 1. The antenna structure 100 may use a metal frame of an electronic device as a radiating body and realize the full coverage from 2.5 GHz to 5 GHz, which may meet the requirement of communication in all kinds of networks for the electronic device, and may even cover N77 frequency band (3.3 GHz to 4.2 GHz) to achieve a global communication mode.

Specifically, as illustrated in FIG. 1, the antenna structure 100 may include a metal frame body 1, a first antenna branch 2, a second antenna branch 3, and an antenna gap 4. The metal frame body 1 may be a reference ground of the antenna structure 100, and the first antenna branch 2 and the second antenna branch 3 are grounded through the metal frame body 1. For example, the first antenna branch 2 is coupled to a first side edge 14 of the metal frame body 1 at a first coupling end 10, and the second antenna branch 3 is coupled to the second edge 15 of the metal frame body 1 at a second coupling end 11. As illustrated in FIG. 1, the first antenna branch 2 is coupled to a left side edge 14 of the metal frame body 1, and the second antenna branch 3 is coupled to a right side edge 15 of the metal frame body 1.

In FIG. 1, both the first antenna branch 2 and the second antenna branch 3 may extend from the respective edge of the metal frame body 1 towards a middle portion of the metal frame body 1, and respective free ends 12 and 13 formed by extension of the first antenna branch 2 and the second antenna branch 3 may cooperatively define the antenna gap 4. In this way, the first antenna branch 2, the third antenna branch 3, and the metal frame body 1 can define a clearance area which is communicated with the outside through the antenna gap 4 to achieve the radiation of antenna signals.

Further, an extension length of the first antenna branch 2 towards the middle portion of the metal frame body 1 is greater than an extension length of the second antenna branch 3 towards the middle portion of the metal frame body 1, that is, the extension length L1 between the first coupling end 10 and the first free end 12 is greater than the extension length L2 between the second coupling end 11 and the second free end 13, as illustrated in FIG. 1. For example, the first antenna branch 2 may have a length in a range of 15 mm to 20 mm, and the second antenna branch 3 may have a length in a range of 5 mm to 8 mm. As illustrated in FIG. 1 again, the antenna structure 100 may further include a feed point 5, and one end 16 of the feed point 5 is coupled to a ground point while the other end 17 of the feed point 5 is coupled to the first antenna branch 2.

Figure 2:
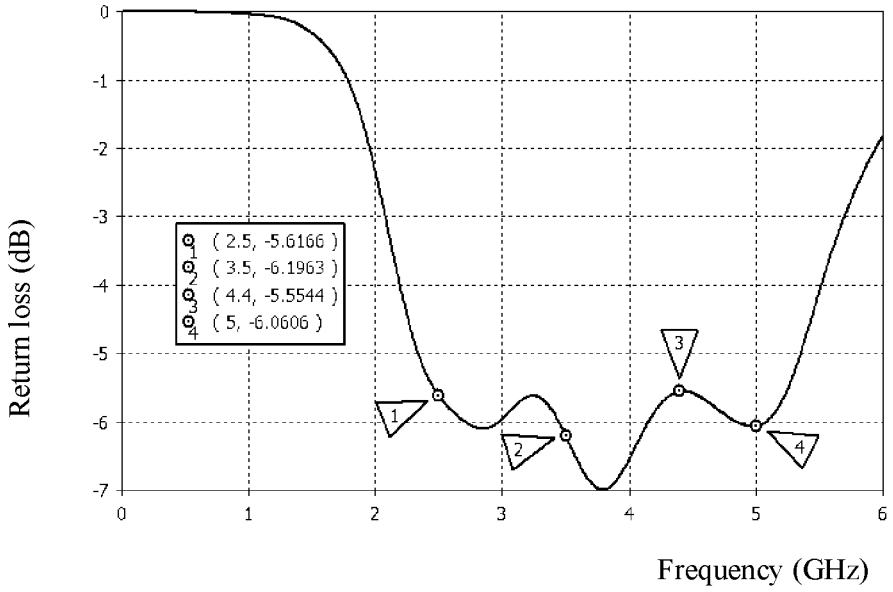
FIG. 2 is a graph illustrating return loss of an antenna structure according to an example.

Based on the antenna structure 100 illustrated in FIG. 1, a graph showing return loss of the antenna structure 100 as illustrated in FIG. 2 can be acquired. As illustrated in FIG. 2, the abscissa represents an antenna frequency (GHz), and the ordinate represents return loss (dB). As illustrated in FIG. 2, four identification points are identified: coordinates of a first identification point is (2.5, −5.6166), coordinates of a second identification point is (3.5, −6.1963), coordinates of a third identification point is (4.4, −5.5544), and coordinates of a fourth identification point is (5, −6.0606). First resonance may be formed between the first identification point and the second identification point, second resonance may be formed between the second identification point and the third identification point, and third resonance may be formed between the third identification point and the fourth identification point. The combined action of the three resonances may achieve the coverage of the entire frequency band ranging from 2.5 GHz to 5 GHz.

Figure 3:
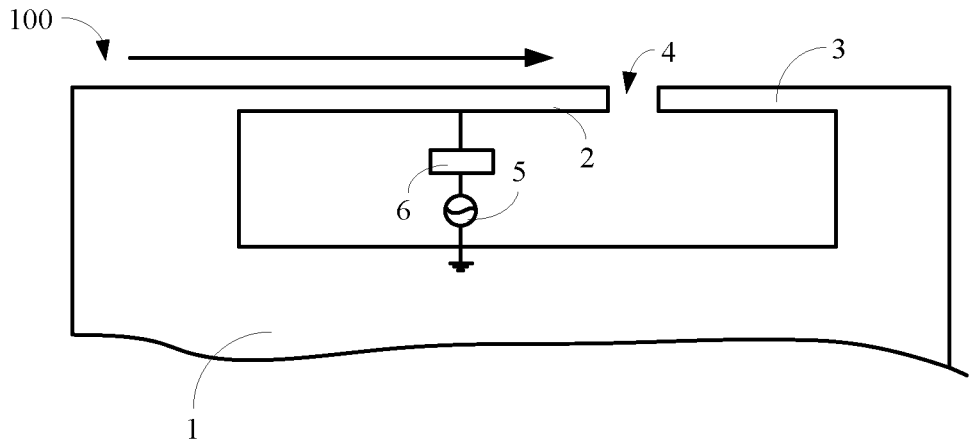
FIG. 3 is a first working schematic diagram of an antenna structure according to an example.
Figure 4:
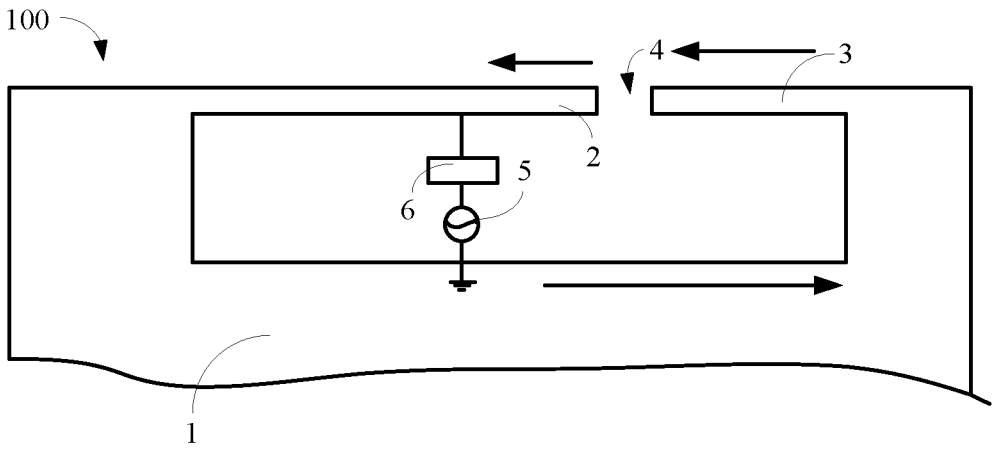
FIG. 4 is a second working schematic diagram of an antenna structure according to an example.
Figure 5:
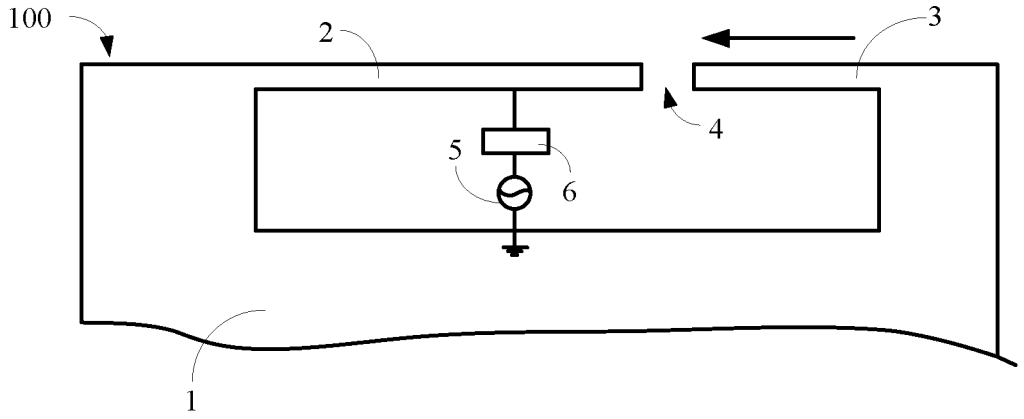
FIG. 5 is a third working schematic diagram of an antenna structure according to an example.
Figure 6:
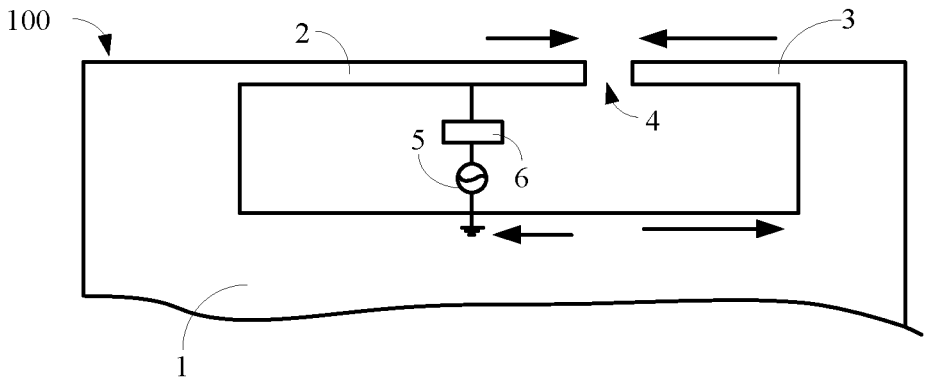
FIG. 6 is a fourth working schematic diagram of an antenna structure according to an example.

Specifically, as illustrated in FIG. 2, the frequency of the first resonance between the first identification point and the second identification point is between 2.5 GHz and 4.5 GHz, and mainly a quarter-wavelength monopole current flows on a length path of the first antenna branch 2 as illustrated in FIG. 3, such that the first antenna branch 2 can be configured to generate antenna signals in N41 frequency band. The frequency of the second resonance between the second identification point and the third identification point is between 3.5 GHz and 4.4 GHz. As illustrated in FIG. 4, mainly in a C-type region defined by a path between the feed point 5 and an end of the first antenna branch 2 close to the antenna gap 4, a length path of the second antenna branch 3, and a path of the ground between the feed point 5 and an end of the second antenna branch 3 in contact with the metal frame body 1, a half-wavelength dipole current with unequal arms flows, thereby generating antenna signals in N78 frequency band under the action of the half-wavelength dipole current. Since the frequency corresponding to N78 frequency band is approximate to the frequency corresponding to N77 frequency band, the C-type region can also generate antenna signals in N77 frequency band. The frequency of the third resonance between the third identification point and the fourth identification point is between 4.4 GHz to 5 GHz. As illustrated in FIG. 5, a quarter-wavelength monopole current mainly flows on a length path of the second antenna branch 3, and as illustrated in FIG. 6, a loop current flows on a length path between the feed point 5 and the end of the first antenna branch 2 close to the antenna gap 4, a length path of the second antenna branch 3, a path of the corresponding ground between the feed point 5 and the end of the first antenna branch 2 close to the antenna gap 4, and a path of the ground corresponding to the second antenna branch 3, such that antenna signals corresponding to N79 frequency band are generated under combined action of the quarter-wavelength monopole current and the loop current.

It can be known from the above examples that the antenna structure 100 in the present disclosure forms a long antenna branch and a short antenna branch by the metal frame of the electronic device and couples the feed point to the first antenna branch 2 which is relatively long, such that the antenna structure 100 covers the entire frequency band of 2.5 GHz to 5 GHz in N41 frequency band, N78 frequency band, and N79 frequency band under the 5G communication protocol. Moreover, since the antenna structure 100 may realize the coverage of the entire frequency band of 2.5 GHz to 5 GHz, it is conducive to subsequently adapting to expansion of the signal bandwidth in the frequency band, and the succession and stability of the antenna structure 100 is good.

In the present example, to make the three resonances in the return loss graph in FIG. 2 as uniform as possible, a connection position of the feed point 5 and the first antenna branch 2 may be located between a first position A and a second position B on the first antenna branch 2 illustrated in FIG. 1. A distance between a connection of the first antenna branch 2 and the metal frame body 1 and the first position A is one half of the extension length L1 of the first antenna branch 2, i.e., L3=½*L1 as illustrated in FIG. 1. A distance between the connection of the first antenna branch 2 and the metal frame body 1 and the second position B is two thirds of the extension length L1 of the first antenna branch 2, i.e., L4=⅔*L1 as illustrated in FIG. 1.

Figure 7:
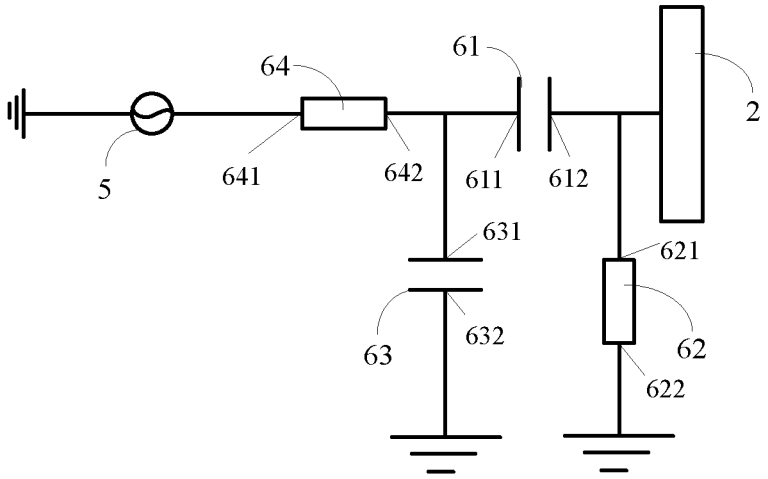
FIG. 7 is a schematic diagram illustrating connection of a first matching circuit, a feed point, and a first antenna branch, according to an example.

In the above examples, as illustrated in FIGS. 1 and 3-6, the antenna structure 100 may further include a first matching circuit 6, one end 18 of the first matching circuit 6 may be coupled to the feed point 5, and the other end 19 of the first matching circuit 6 may be coupled to the first antenna branch 2. As illustrated in FIG. 7, the first matching circuit 6 may include a first capacitor 61 and a first inductor 62; one end 611 of the first capacitor 61 is coupled to the feed point 5, and the other end 612 of the first capacitor 61 is coupled to the first antenna branch 2; one end 621 of the first inductor 62 is coupled between the feed point 5 and the first antenna branch 2, and the other end 622 of the first inductor 62 is grounded. Thus, by adjusting at least one of a capacitance value of the first capacitor 61 and an inductance value of the first inductor 62, impedance matching can be performed when the antenna structure 100 radiates low-frequency signals, such that the low-frequency resonances illustrated in FIG. 2 may evenly fall in the frequency band.

Further, as illustrated in FIG. 7, the first matching circuit 6 may further include a second capacitor 63 and a second inductor 64; one end 631 of the second capacitor 63 is coupled between the feed point 5 and the first antenna branch 2, and the other end 632 of the second capacitor 63 is grounded; one end 641 of the second inductor 64 is coupled to the feed point 5, and the other end 642 of the second inductor 64 is coupled to the first antenna branch 2. Thus, by adjusting at least one of a capacitance value of the second capacitor 63 and an inductance value of the second inductor 64, impedance matching can be performed when the antenna structure 100 radiates high-frequency signals, such that the high-frequency resonances illustrated in FIG. 2 may evenly fall in the frequency band.

It should be noted that besides the first capacitor 61, the first inductor 62, the second capacitor 63, and the second inductor 64, the first matching circuit 6 can certainly include at least one kind of other inductors, capacitors and resistors, which will not be limited herein.

In the examples illustrated in FIGS. 1-7, the frequency band coverage of the antenna structure 100 is realized by passive elements such as capacitors and inductors. However, it could be understood that the operating environment of the antenna structure 100 usually changes, and the antenna structure 100 may also need to be used in a harsh environment which causes degradation of the antenna performance. For example, with the development of curved screen technology, the width of the metal frame of the electronic device is sharply reduced, and the distance between the metal frame and absorption materials and the distance between the metal frame and the ground are reduced, which may cause that the return loss of the antenna structure 100 configured with the first matching circuit 6 in the above examples is shallowed from about −6 dB to about −3 dB, affecting the radiation ability.

Figure 8:
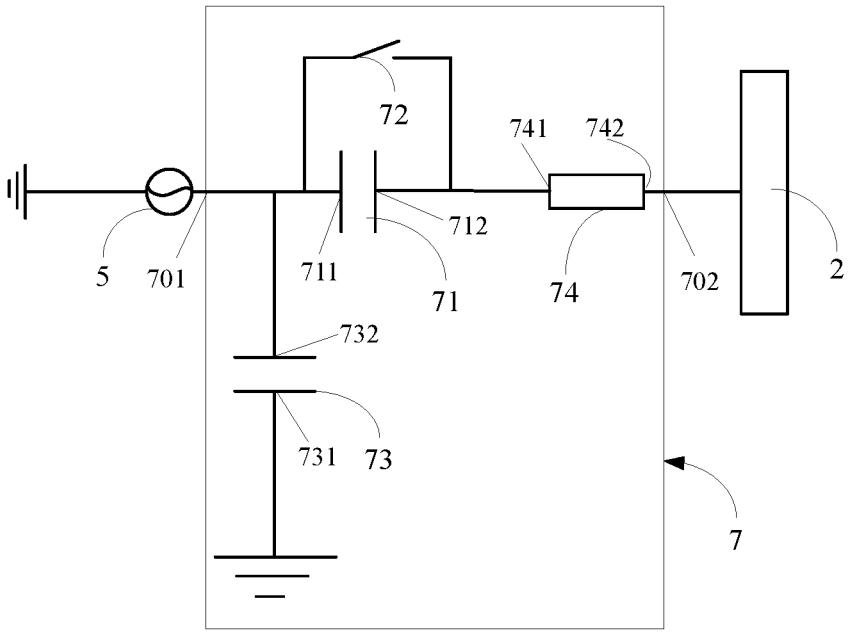
FIG. 8 is a schematic diagram illustrating connection of a second matching circuit, a feed point, and a first antenna branch, according to an example.

Therefore, the present disclosure also provides a second matching circuit 7 as illustrated in FIG. 8. One end 701 of the second matching circuit 7 is coupled to the feed point 5, and the other end 702 of the second matching circuit 7 is coupled to the first antenna branch 2. The second matching circuit 7 may include a third capacitor 71 and a switch circuit 72. One end 711 of the third capacitor 71 is coupled to the feed point 5, and the other end 712 of the third capacitor 71 is coupled to the first antenna branch 2. The switch circuit 72 is coupled to the third capacitor 71 in parallel, and the working state of the third capacitor 71 is switched by an on/off state of the switch circuit 72, so as to switch the working frequency band of the antenna structure 100.

Specifically, the switch circuit 72 may include an on state and an off state. When the switch circuit 72 is in the off state, the third capacitor 71 is in the working state, and the working frequency band of the antenna structure 100 includes N41 frequency band and N79 frequency band. When the switch circuit 72 is in the on state, the third capacitor 71 is short-circuited, and the working frequency band of the antenna structure 100 includes N77 frequency band and N78 frequency band.

Figure 9:
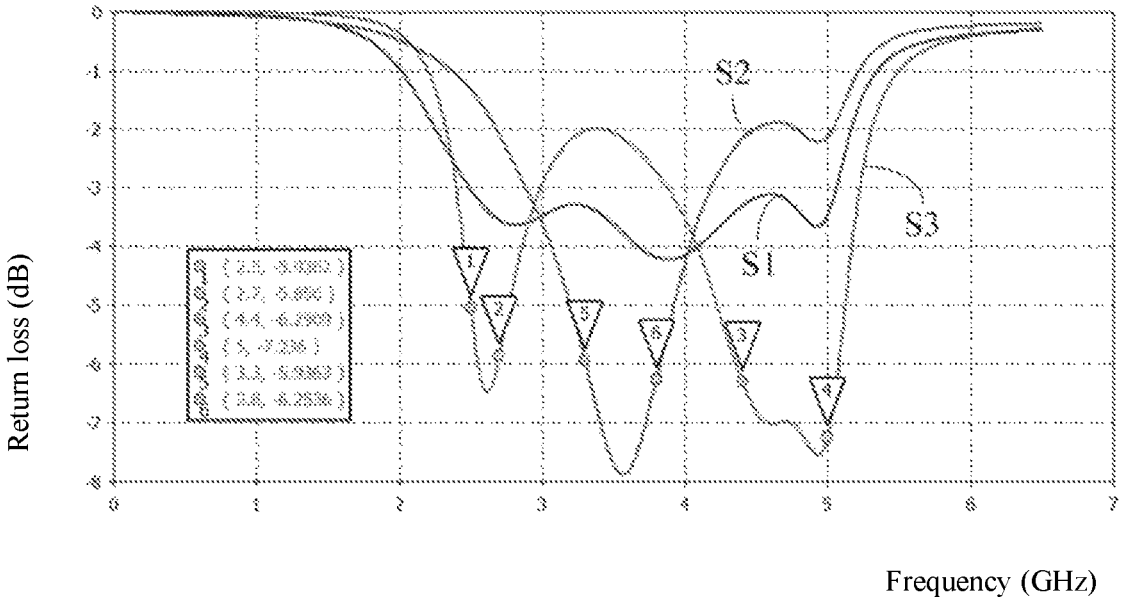
FIG. 9 is a graph illustrating return loss of another antenna structure according to an example.

In the same environment, a graph comparing return loss curves when the antenna structure adopts the first matching circuit 6 and when the antenna structure adopts the second matching circuit 7 is illustrated in FIG. 9.

As illustrated in FIG. 9, S1 is a return loss curve when the antenna structure 100 adopts the first matching circuit 6, and S2 and S3 are return loss curves when the antenna structure 100 adopts the second matching circuit 7. The switch circuit 72 corresponding to the curve S2 is in the off state, and the switch circuit 72 corresponding to the curve S3 is in the on state. Firstly, according to resonance between a first identification point (2.5, −5.0362) and a second identification point (2.7, −5.856) on the curve S3, it can be known that when the switch circuit 72 is in the off state, the antenna structure 100 may generate antenna signals within N41 frequency band, and compared with the return loss of the curve S1 in the adjacent resonance, the return loss of S2 is deeper and the matching degree is higher. Similarly, according to resonance between a third identification point (4.4, −6.2909) and a fourth identification point (5, −7.236) on the curve S3, it can be known that when the switch circuit 72 is in the off state, the antenna structure 100 may generate antenna signals within N79 frequency band, and the return loss of the curve S2 is deeper and the matching degree is higher compared with the return loss of the curve S1 in the adjacent resonance. In addition, according to the resonance between a fifth identification point (3.3, −5.9363) and a sixth identification point (3.8, −6.2536) on the curve S2, it can be known that when the switch circuit 72 is in the on state, the antenna structure 100 may generate antenna signals within N77 and N78 frequency bands, and compared with the return loss of the curve S1 in the adjacent resonance, the return loss of the curve S3 is deeper and the matching degree is higher.

Figure 10:
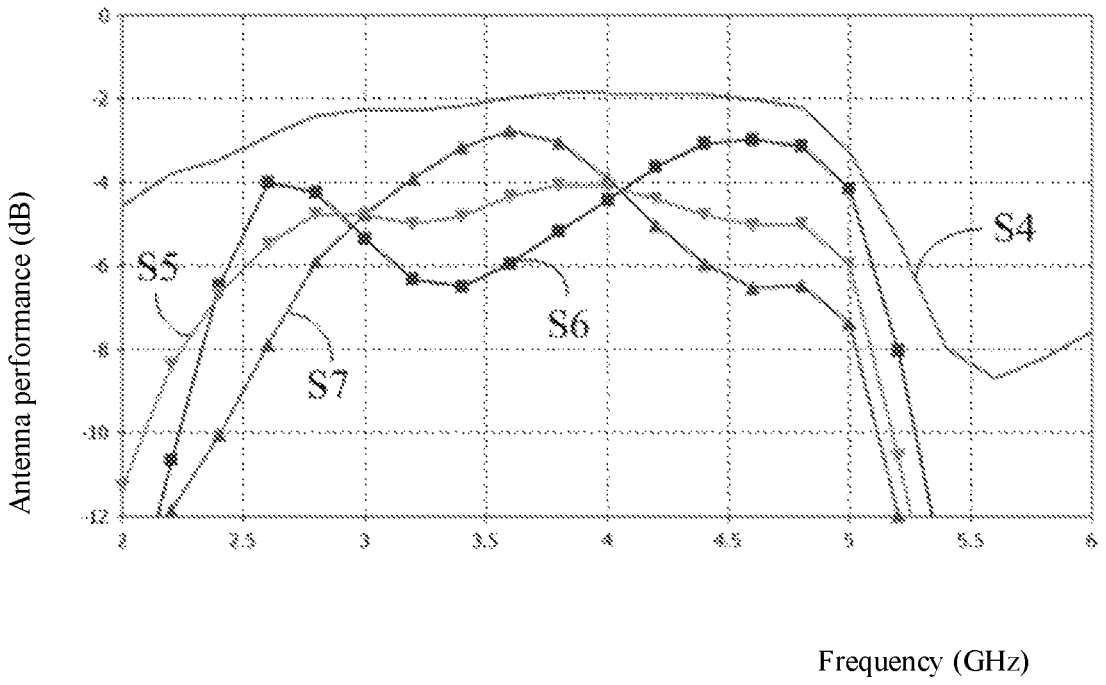
FIG. 10 is a graph illustrating antenna performance of the antenna structure in the example of FIG. 9.

Further, a graph showing the antenna performance is illustrated in FIG. 10. A curve S4 is a theoretical curve of the antenna performance; S5 is an antenna performance curve when the antenna structure 100 adopts the first matching circuit 6; S6 is an antenna performance curve when the antenna structure 100 adopts the second matching circuit 7 and the switch circuit 72 is in the off state; and S7 is an antenna performance curve when the antenna structure 100 adopts the second matching circuit 7 and the switch circuit 72 is in the on state. Due to the loss of the antenna structure 100 in an actual process, the antenna performance indicated by the curve S5, the curve S6 and the curve S7 is lower than that indicated by the curve S4. Through comparison between the curve S5 and the curve S6, it can be known that when the antenna structure 100 adopts the second matching circuit 7 and the switch circuit 72 is in the off state, the antenna performance of the antenna structure 100 working in N41 and N79 frequency bands is higher than the antenna performance of the antenna structure 100 when it adopts the first matching circuit 6 and works in N41 and N79 frequency bands. Through comparison between the curve S5 and the curve S7, it can be known that when the antenna structure 100 adopts the second matching circuit 7 and the switch circuit 72 is in the on state, the antenna performance of the antenna structure 100 working in N77 and N78 frequency bands is higher than the antenna performance of the antenna structure 100 when it adopts the first matching circuit 6 and works in N77 and N78 frequency bands.

Thus, when configured with the second matching circuit 7, the antenna structure 100 may be more adapted to different environments. It should be noted that the second matching circuit 7 may include at least one kind of other inductors, capacitors and resistors, besides the third capacitor 71 and the switch circuit 72. Still as illustrated in FIG. 8, the second matching circuit 7 may further include a capacitor 73 with one end 731 grounded and the other end 732 coupled between the third capacitor 71 and the feed point 5, and an inductor 74 with one end 741 coupled to the feed point 5 and the other end 742 coupled to the first antenna branch 2. Of course, there may be other situations which will not be elaborated herein.

Based on the antenna structure 100 adopting the first matching circuit 6 and the antenna structure 100 adopting the second matching circuit 7 in the above examples, another antenna structure 100 may be obtained in the present disclosure by lengthening the first antenna branch 2. Compared with the above examples, the low-frequency coverage range of this antenna structure 100 may be broadened. For example, the coverage range may be broadened to 1.176 GHz±1.023 MHz, such that the antenna structure 100 may work in L5 frequency band of GPS to achieve more accurate positioning; or the coverage range may be broadened to 1.575 GHz±1.023 MHz, such that the antenna structure 100 may work in L1 frequency band of GPS; or the frequency bands of 2.4 GHz and 5 GHz Wi-Fi may be also covered, which will be described in detail below.

Figure 11:
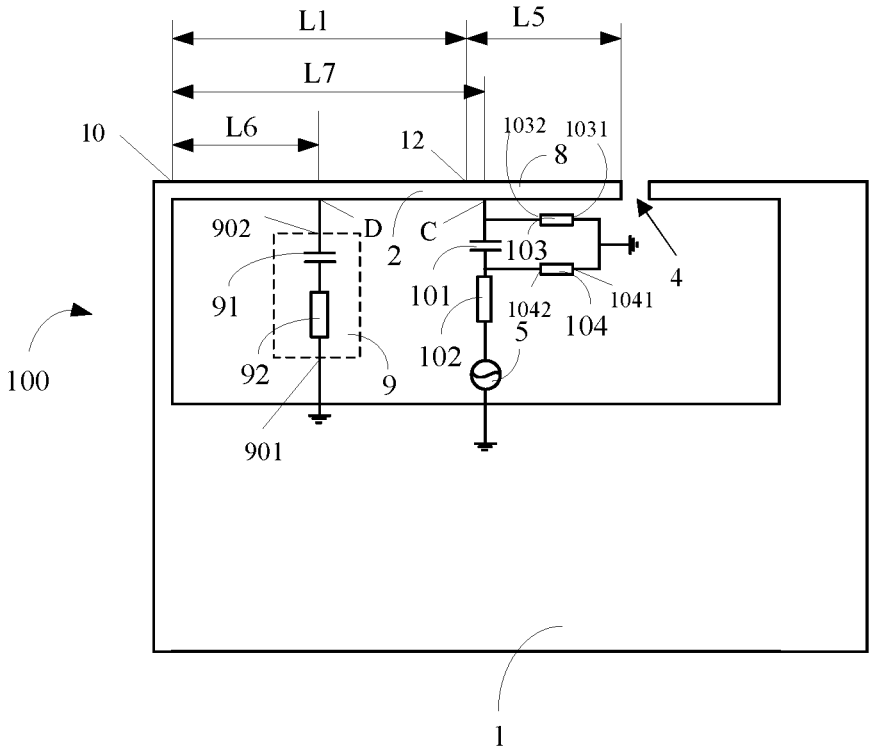
FIG. 11 is a structural diagram of another antenna structure according to an example.

Specifically, as illustrated in FIG. 11, the antenna structure 100 may further include an extended antenna 8 coupled to a first free end 12 of the first antenna branch 2 and separated from the second antenna branch 3 through the antenna gap 4. The length of the extended antenna 8 is between one third of the extension length L1 of the first antenna branch 2 and one half of the extension length L1 of the first antenna branch 2. The feed point 5 may be coupled to a third position C on the first antenna branch 2, the third position C is at a first length away from a first coupling end 10 of the first antenna branch 2 coupled to the metal frame body 1, and the first length equals to two thirds of a sum of the length of the extended antenna 8 and the length of the first antenna branch 2. The antenna structure 100 may further include a tuned circuit 9. One end 901 of the tuned circuit 9 is grounded, the other end 902 of the tuned circuit 9 is coupled to a fourth position D on the first antenna branch 2 which is at a second length away from the first coupling end 10, and the second length equals to one third of the sum of the length of the extended antenna 8 and the length of the first antenna branch 2.

Figure 12:
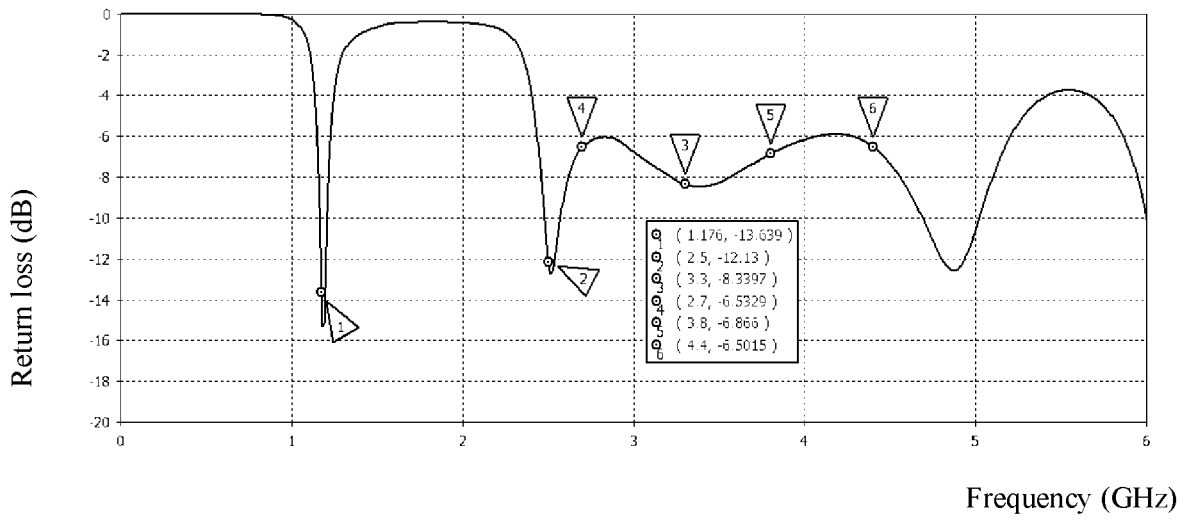
FIG. 12 is a graph illustrating return loss of still another antenna structure according to an example.

In an example, as illustrated in FIG. 11, the length of the first antenna branch 2 is L1, and the length of the extended antenna 8 is L5, in which L5=½*L1. A distance from the connection between the first antenna branch 2 and the metal frame body 1 (i.e., the first coupling end 10) to the connection between the feed point 5 and the first antenna branch 2 (i.e., the third position C) is L7, and a distance from the connection between the first antenna branch 2 and the metal frame body 1 (i.e., the first coupling end 10) to the connection between the tuned circuit 9 and the first antenna branch 2 (i.e., the fourth position D) is L6, in which L7=⅔*(L1+L5), and L6=⅓*(L1+L5). The connection position of the feed point 5 and the first antenna branch 2 is closer to the antenna gap 4 than the connection position of the tuned circuit 9 and the first antenna branch 2. The tuned circuit 9 may include a fourth capacitor 91 and a fourth inductor 92 coupled in series. Based on this, a radiating body on the left side may radiate a lower frequency band since the length of the radiating body on the left side of the metal frame body 1 is lengthened through the extended antenna 8. Thus, in order to enable the antenna structure 100 to cover N41 frequency band, in the present disclosure, a grounded tuned circuit is additionally provided while the radiating body on the left side is lengthened. As illustrated in FIG. 12, the antenna structure 100 may still generate resonance between the second identification point (2.5, −12.13) and the fourth identification point (2.7, −6.5329), so as to cover N41 frequency band. Moreover, since the antenna structure 100 mainly generates N77 frequency band, N78 frequency band, and N79 frequency band through the second antenna branch 3 and the path between the feed point 5 and the antenna gap 4, the generation of N7 frequency band, N78 frequency band and N79 frequency band by the antenna structure 100 will be little influenced by the addition of the extended antenna 8 to the first antenna branch 2. Therefore, as illustrated in FIG. 12, resonance exists between the third identification point (3.3, −8.3397) and the fifth identification point (3.8, −6.866), and the antenna structure 100 may cover N77 frequency band and N78 frequency band; resonance exists after the sixth identification point (4.4, −6.5015), and the antenna structure 100 may cover N79 frequency band.

Further, since the first antenna branch 2 is lengthened by the extended antenna 8, and the tuned circuit 9 may be equivalent to a capacitor load in L5 frequency band of GPS, combined with the combined action of the two may bring down the frequency and produce resonance in L5 frequency band of GPS.

Figure 13:
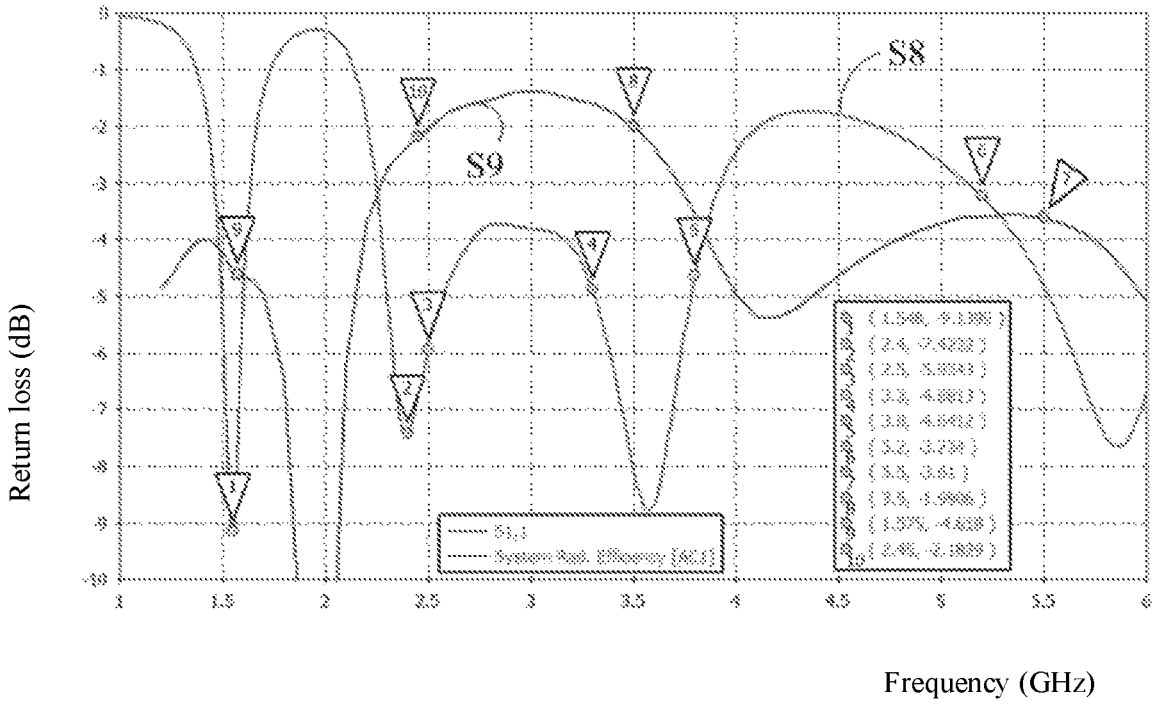
FIG. 13 is a graph illustrating return loss and antenna performance of an antenna structure according to an example.

In another example, the length L5 of the extended antenna 8 is less than ½*L1. Compared with L5=½*L1, the increment in the length of the first antenna branch 2 is reduced, so the minimum frequency covered by the antenna structure 100 may be improved, and the antenna structure 100 may also generate resonance working in L1 frequency band of GPS. Specifically, as illustrated in FIG. 13, a curve S8 is a return loss curve of the antenna structure 100, and S9 is an antenna performance curve. In the curve S8, the resonance working in L1 frequency band of GPS may be generated near the first identification point (1.548, −9.1399), and the antenna structure 100 may work in L1 frequency band of GPS. According to the comparison between the curve near the ninth identification point (1.575, −4.618) of the curve S9 and the curve near the first identification point (1.548, −9.1399) of the curve S8, the antenna performance is better.

Resonance working in 2.4 GHz Wi-Fi frequency band may be generated near the second identification point (2.4, −7.4222) and the third identification point (2.5, −5.9343) of the curve S8, and the antenna structure 100 may work in 2.4

GHz Wi-Fi frequency band. Resonance working in N77 frequency band and N78 frequency band may be generated near the fourth identification point (3.3, −4.8813) and the fifth identification point (3.8, −4.6412) of the curve S8, and the antenna structure 100 may work in N77 frequency band and N78 frequency band. According to the comparison between the curve near the tenth identification point (2.45, −2.1829) and the eighth identification point (3.5, −1.9906) of the curve S9 and the curve near the second identification point (2.4, −7.4222) and the fifth identification point (3.8, −4.6412) of the curve S8, the antenna performance is better.

The sixth identification point (5.2, −3.234) in the curve S8 may generate resonance working in 5 GHz Wi-Fi frequency band, and the antenna structure 100 may work in 5 GHz Wi-Fi frequency band. Moreover, according to the comparison between the curve near the seventh identification point (5.5, −3.61) of the curve S9 and the sixth identification point (5.2, −3.234) of the curve S8, the antenna performance is better.

Based on the above two examples, as illustrated in FIG. 11, the antenna structure 100 may further include a third matching circuit 10. The third matching circuit 10 may include a fifth capacitor 101 and a fifth inductor 102. The fifth capacitor 101 and the fifth inductor 102 are coupled in series and are provided between the feed point 5 and the first antenna branch 2 or between the feed point 5 and the extended antenna 8 (specifically determined according to the relationship between the length of the extended antenna and the length of the first antenna branch 2). By further tuning effects of the fifth capacitor 101 and the fifth inductor 102, the radiation frequency of the antenna structure 100 may be reduced, and L5 and L1 frequency bands of GPS may be covered.

It should be noted that the third matching circuit 10 may include one or more kinds of other capacitors, resistors, and inductors besides the fifth capacitor 101 and the fifth inductor 102. For example, in FIG. 11, the third matching circuit 10 may further include a sixth inductor 103 and a seventh inductor 104 coupled in parallel and both grounded. One end 1031 of the sixth inductor 103 is grounded, while the other end 1032 of the sixth inductor 103 may be coupled to the first antenna branch 2 or the extended antenna 8. One end 1041 of the seventh inductor 104 is grounded, while the other end 1042 of the seventh inductor 104 may be coupled between the fifth inductor 102 and the fifth capacitor 101. Thus, better impedance matching may be achieved and the antenna efficiency may be improved. Of course, there may be other capacitors or inductors, which will not be illustrated herein.

The present disclosure also provides an electronic device including the antenna structure 100 according to any one of the above examples. The electronic device may include a mobile phone terminal, a tablet terminal, a smart home and other devices, which will not be limited herein.

Other examples of the present disclosure will be apparent to those skilled in the art from consideration of the specification and practice of the present disclosure. This application is intended to cover any variations, uses, or adaptations of the present disclosure, which are in accordance with the general principles of the present disclosure and include common knowledge or conventional technical means in the art that are not disclosed herein. The specification and examples are considered to be exemplary only, and the true scope of the present disclosure is indicated by the following claims.

It should be appreciated that the present disclosure is not limited to the specific structures described above and illustrated in the drawings, and that various modifications and changes can be made without departing from the scope of the present disclosure. The scope of the present disclosure is limited only by the appended claims.

What is claimed is:

1. An antenna structure, comprising:

a metal frame body;

a first antenna branch coupled to a first side edge of the metal frame body, the first antenna comprising a first free end extending towards a middle of the metal frame body;

a second antenna branch coupled to a second side edge of the metal frame body, the second antenna comprising a second free end extending towards the middle of the metal frame body;

an antenna gap defined by the first free end and the second free end, wherein a first extension length of the first antenna branch is greater than a second extension length of the second antenna branch;

a feed point comprising a first end coupled to a ground point and a second end coupled to the first antenna branch;

an extended antenna coupled to the first free end of the first antenna branch and separated from the second antenna branch by the antenna gap; and a matching circuit that comprises a capacitor and an inductor coupled in series, wherein the capacitor and the inductor are provided between the feed point and the first antenna branch or between the feed point and the extended antenna, and wherein the matching circuit further comprises another inductor with one end grounded and another end coupled to the first antenna branch or the extended antenna, and another inductor with one end grounded and another end coupled between the inductor and the capacitor.

2. The antenna structure according to claim 1, wherein the second end of the feed point is coupled to the first antenna branch between a first position and a second position on the first antenna branch;

a distance between a connection of the first antenna branch and the metal frame body and the first position is one half of the extension length of the first antenna branch; and a distance between the connection of the first antenna branch and the metal frame body and the second position is two thirds of the extension length of the first antenna branch.

3. The antenna structure according to claim 1, further comprising:

a first matching circuit, wherein the first matching circuit comprises:

a first capacitor with one end coupled to the feed point and another end coupled to the first antenna branch; and a first inductor with one end coupled between the feed point and the first antenna branch and another end grounded, wherein at least one of the first capacitor and the first inductor performs impedance matching when the antenna structure radiates low-frequency signals.

4. The antenna structure according to claim 3, wherein the first matching circuit further comprises:

a second capacitor with one end coupled between the feed point and the first antenna branch and another end grounded; and a second inductor with one end coupled to the feed point and another end coupled to the first antenna branch;

wherein at least one of the second capacitor and the second inductor performs impedance matching when the antenna structure radiates high-frequency signals.

5. The antenna structure according to claim 1, further comprising:

a second matching circuit, wherein the second matching circuit comprises:

a third capacitor with one end coupled to the feed point and another end coupled to the first antenna branch; and a switch circuit coupled to the third capacitor in parallel, wherein the switch circuit, through switching between an on state and an off state, is configured to switch a state of the third capacitor and a working frequency band of the antenna structure.

6. The antenna structure according to claim 5, wherein the switch circuit comprises the on state and the off state;

when the switch circuit is in the off state, the third capacitor is in a working state, and the working frequency band of the antenna structure comprises N41 frequency band and N79 frequency band; and when the switch circuit is in the on state, the third capacitor is short-circuited, and the working frequency band of the antenna structure comprises N77 frequency band and N78 frequency band.

7. The antenna structure according to claim 1, wherein:

a length of the extended antenna is between one third of the extension length of the first antenna branch and one half of the extension length of the first antenna branch; the second end of the feed point is coupled to a third position on the first antenna branch, the third position is at a first length away from a connection of the first antenna branch and the metal frame body, and the first length is two thirds of a sum of the length of the extended antenna and the extension length of the first antenna branch;

the antenna structure further comprises a tuned circuit with one end grounded and another end coupled to a fourth position on the first antenna branch, wherein the fourth position is at a second length away from the connection of the first antenna branch and the metal frame body, and the second length is one third of the sum of the length of the extended antenna and the extension length of the first antenna branch.

8. The antenna structure according to claim 7, wherein the length of the extended antenna is one half of the extension length of the first antenna branch, and the tuned circuit comprises a fourth capacitor and a fourth inductor coupled in series.

9. The antenna structure according to claim 1, wherein the extension length of the first antenna branch is between 15 mm and 20 mm, and the extension length of the second antenna branch is between 5 mm and 8 mm.

10. An electronic device, comprising:

an antenna structure, wherein the antenna structure comprises:

a metal frame body;

a first antenna branch coupled to a first side edge of the metal frame body, the first antenna comprising a first free end extending towards a middle of the metal frame body;

a second antenna branch coupled to a second side edge of the metal frame body, the second antenna comprising a second free end extending towards the middle of the metal frame body;

an antenna gap defined by the first free end and the second free end, wherein a first extension length of the first antenna branch is greater than a second extension length of the second antenna branch;

a feed point with a first end coupled to a ground point and a second end coupled to the first antenna branch;

an extended antenna coupled to the first free end of the first antenna branch and separated from the second antenna branch by the antenna gap; and a matching circuit that comprises a capacitor and an inductor coupled in series, wherein the capacitor and the inductor are provided between the feed point and the first antenna branch or between the feed point and the extended antenna, and wherein the matching circuit further comprises another inductor with one end grounded and another end coupled to the first antenna branch or the extended antenna, and another inductor with one end grounded and another end coupled between the inductor and the capacitor.

11. The electronic device according to claim 10, wherein the second end of the feed point is coupled to the first antenna branch between a first position and a second position on the first antenna branch;

a distance between a connection of the first antenna branch and the metal frame body and the first position is one half of the extension length of the first antenna branch; and a distance between the connection of the first antenna branch and the metal frame body and the second position is two thirds of the extension length of the first antenna branch.

12. The electronic device according to claim 10, wherein the antenna structure further comprises a first matching circuit, and the first matching circuit comprises:

a first capacitor with one end coupled to the feed point and another end coupled to the first antenna branch; and a first inductor with one end coupled between the feed point and the first antenna branch and another end grounded;

wherein at least one of the first capacitor and the first inductor performs impedance matching when the antenna structure radiates low-frequency signals.

13. The electronic device according to claim 12, wherein the first matching circuit further comprises:

a second capacitor with one end coupled between the feed point and the first antenna branch and another end grounded; and a second inductor with one end coupled to the feed point and another end coupled to the first antenna branch;

wherein at least one of the second capacitor and the second inductor performs impedance matching when the antenna structure radiates high-frequency signals.

14. The electronic device according to claim 10, wherein the antenna structure further comprises a second matching circuit, and the second matching circuit comprises:

a third capacitor with one end coupled to the feed point and another end coupled to the first antenna branch; and a switch circuit coupled to the third capacitor in parallel, wherein the switch circuit, through switching between an on state and an off state, is configured to switch a state of the third capacitor and a working frequency band of the antenna structure.

15. The electronic device according to claim 14, wherein the switch circuit comprises an on state and an off state;

when the switch circuit is in the off state, the third capacitor is in a working state, and the working frequency band of the antenna structure comprises N41 frequency band and N79 frequency band; and when the switch circuit is in the on state, the third capacitor is short-circuited, and the working frequency band of the antenna structure comprises N77 frequency band and N78 frequency band.

16. The electronic device according to claim 10, wherein:

a length of the extended antenna is between one third of the extension length of the first antenna branch and one half of the extension length of the first antenna branch; the second end of the feed point is coupled to a third position on the first antenna branch, the third position is at a first length away from a connection of the first antenna branch and the metal frame body, and the first length is two thirds of a sum of the length of the extended antenna and the extension length of the first antenna branch;

the antenna structure further comprises a tuned circuit with one end grounded and another end coupled to a fourth position on the first antenna branch, wherein the fourth position is at a second length away from the connection of the first antenna branch and the metal frame body, and the second length is one third of the sum of the length of the extended antenna and the extension length of the first antenna branch.

17. The electronic device according to claim 16, wherein the length of the extended antenna is one half of the extension length of the first antenna branch, and the tuned circuit comprises a fourth capacitor and a fourth inductor coupled in series.

* * * * *